US007004091B2

(12) United States Patent
Adamczyk et al.

(10) Patent No.: US 7,004,091 B2
(45) Date of Patent: Feb. 28, 2006

(54) CONVERTIBLE PERSONAL WATERCRAFT

(75) Inventors: Rick Adamczyk, St. Cloud, FL (US); Yves Berthiaume, Mont. St. Hilaire (CA); Tom Bucaccio, Grant, FL (US)

(73) Assignee: Bombardier Recreational Products Inc., Montreal (CA)

( * ) Notice: Subject to any disclaimer, the term of this patent is extended or adjusted under 35 U.S.C. 154(b) by 190 days.

(21) Appl. No.: 10/427,911

(22) Filed: May 2, 2003

(65) Prior Publication Data

US 2004/0003767 A1 Jan. 8, 2004

Related U.S. Application Data

(60) Provisional application No. 60/376,844, filed on May 2, 2002.

(51) Int. Cl.
*B63B 35/73* (2006.01)

(52) U.S. Cl. ..... 114/55.52; 114/55.57; 114/363

(58) Field of Classification Search ..... 114/55.52, 114/55.57, 363; 297/195.1, 195.11, 215.13, 297/215.14, 215.15
See application file for complete search history.

(56) References Cited

U.S. PATENT DOCUMENTS

| | | | | |
|---|---|---|---|---|
| 3,826,220 A | | 7/1974 | Jacobson | |
| 4,320,713 A | | 3/1982 | Nishida et al. | |
| 4,380,208 A | | 4/1983 | Goserud | |
| 4,694,770 A | | 9/1987 | Kitner et al. | |
| 4,703,710 A | | 11/1987 | Kawahara | |
| 4,754,724 A | | 7/1988 | Murakami et al. | |
| 5,282,437 A | | 2/1994 | Avillez de Basto | |
| 5,309,861 A | * | 5/1994 | Mardikian | 114/363 |
| 5,542,371 A | * | 8/1996 | Harvey et al. | 114/363 |
| 5,915,329 A | * | 6/1999 | Watkins et al. | 114/363 |
| 6,135,047 A | | 10/2000 | Miller | |
| 6,152,062 A | * | 11/2000 | Hattori | 114/343 |

* cited by examiner

*Primary Examiner*—Sherman Basinger

(57) ABSTRACT

A personal watercraft (PWC) is disclosed that is convertible between a stand-up type watercraft, and at least one of a straddle-type watercraft and a sit-down type watercraft. The PWC includes a hull supporting a power source, and a deck, the deck supporting a steering handle support assembly. A seat assembly is removably supported by the deck, such that the seat assembly can be selectively removed by the user so that the personal watercraft can be operated with and without the seat assembly.

22 Claims, 13 Drawing Sheets

CONVERTIBLE PERSONAL WATERCRAFT

CROSS-REFERENCE TO RELATED APPLICATIONS

This application claims the benefit of priority to U.S. Provisional Application No. 60/376,844, titled "CONVERTIBLE PERSONAL WATERCRAFT," filed May 2, 2002, which is incorporated by reference herein in its entirety.

BACKGROUND OF THE INVENTION

1. Field of the Invention

This invention relates to a personal watercraft ("PWC"), and more particularly to a PWC that is convertible between a stand-up type watercraft, and at least one of a straddle-type watercraft and a sit-down type watercraft.

2. Description of the Related Art

Jet powered watercraft have become very popular in recent years for recreational use and for use as transportation in coastal communities. The jet power offers high performance, which improves acceleration, handling and shallow water operation. Accordingly, PWCs, which typically employ jet propulsion, have become common place, especially in resort areas.

There are at least two different types of PWCs that are configured for different driving and riding styles and preferences. For example, a stand-up type PWC is typically configured with a deck that supports a platform. In this configuration, the driver stands on the platform while driving the PWC. Unlike the other types of PWCs, the stand-up type is not equipped with a seat on which the driver can sit. The steering handle on a stand-up type PWC is configured to be adjustable so that drivers of different heights can comfortably steer the watercraft. Stand-up type PWCs tend to be used by drivers who are more athletic and desire high performance. The driver can adjust the center of gravity of the PWC by adjusting his/her position on the platform. Also, the driver can use his/her body to lean into turns more easily.

In contrast, a straddle-type PWC is configured with a deck that supports a straddle-type seat. The driver sits on top of the seat and places each foot on opposite sides of the seat so as to "straddle" the seat. Many straddle-type PWCs can accommodate more than one rider with a passenger seated behind the driver. The steering handle of a straddle-type PWC is typically configured to be fixed in a pre-determined location at a pre-determined angle. During operation, the straddle-type PWC tends to feel more stable than the stand-up type. This is largely because the center of gravity of the straddle-type PWC is less variable than the center of gravity of a stand-up type PWC since the driver remains more or less in the same position. This appeals to a different type of PWC driver than a typical stand-up driver. An advantage of the straddle-type PWC is that it allows riders to travel over longer distances more comfortably.

Unfortunately, if a person enjoys operating more than one type of PWC, he/she must physically use more than one PWC to get the full experience that PWCs can offer. Moreover, if more than one person operates the same PWC, the driving style is limited to the type of PWC available. For example, if a rider must rely on a PWC for regular transportation, he or she may prefer to have a sit-down type PWC. If a rider wants to experience the high performance that is often associated with the stand-up type PWC, he or she must use a different PWC. Also, if a family wishes to purchase a PWC, they must compromise on a type of PWC that will allow each family member to operate the PWC.

Therefore, there is a need for a single PWC that gives the operator an option of which type of PWC he or she wants to use at any given outing.

SUMMARY OF THE INVENTION

An aspect of embodiments of the present invention is to provide a single PWC that can be configured to be convertible between a stand-up type watercraft and at least one of a straddle-type watercraft and a sit-down type watercraft.

Another aspect of embodiments of the present invention is to provide a seat assembly for a PWC that is fully removable.

The invention is directed to a PWC that includes a hull, a deck supported by the hull, a power source supported by the hull, a steering handle support assembly supported by the deck, and a seat assembly removably supported by the deck, such that the seat assembly can be selectively removed by the user so that the personal watercraft can be operated with and without the seat assembly. The seat assembly releasably connects to the steering handle support assembly at a first attachment point.

The invention is also directed to a seat assembly for use with a PWC that includes a seat, a seat frame, a first releasable connector for connecting the seat frame to a first point on the PWC and a second releasable connector for connecting the seat frame to a second point on the PWC.

Another aspect of the invention is to provide a personal watercraft having a hull supporting a power source, and a deck supporting a steering handle support assembly. The steering handle support assembly has an attachment assembly that is configured to attach a seating module.

These and other aspects of embodiments of the invention will become apparent when taken in conjunction with the following detailed description and drawings.

BRIEF DESCRIPTION OF THE DRAWINGS

Features of the invention are shown in drawings, which form part of this original disclosure, in which like parts in the figures are labeled with the same reference numbers. Preferred embodiments of the invention will be described in conjunction with the following drawings, in which.

DETAILED DESCRIPTION OF PREFERRED EMBODIMENTS OF THE INVENTION

As described in further detail below, the invention comprises a base hull and deck combination that can be converted by a user between a stand-up PWC, a straddle-type PWC, and a sit-down PWC. Preferably, the change between types can be accomplished by an average operator without the use of specialized tools. The PWC includes several components that are removable as discussed below. Although, one type of common PWC is shown in the figures, this invention is suitable for use into any known type of PWC.

The stand-up type configuration resembles a standard stand-up PWC with a front support pole assembly that pivots about a horizontal axis with the addition of various attachment points. Modules or components are added to the stand-up configuration to obtain the other two configurations.

The straddle-type configuration has a straddle seat attached near the front of the deck to the front pole assembly and at the back of the deck to the floor of the watercraft. Alternatively, the straddle-type seat can be attached at the front to the front pole assembly and to a portion of the deck, or suspended from the front pole assembly or the front of the deck, to form a cantilever design. Preferably, the straddle-type seat has a suspension system.

The sit-down configuration has a bucket seat that can be attached to the base of the watercraft, or suspended from the front pole assembly or the front of the deck. The bucket seat can also be equipped with a suspension system.

FIGS. 1–4 and 6 show a preferred embodiment of a convertible PWC 10 of the current invention, which is not intended to be limiting but merely representative of the invention. The figures show conversion between the straddle-type and the stand-up type configurations. The sit-down type configuration is not shown in this particular embodiment but a sit-down seat, for example of the type shown in FIG. 14, may be attached in a similar manner as the straddle seat.

Figure 1:
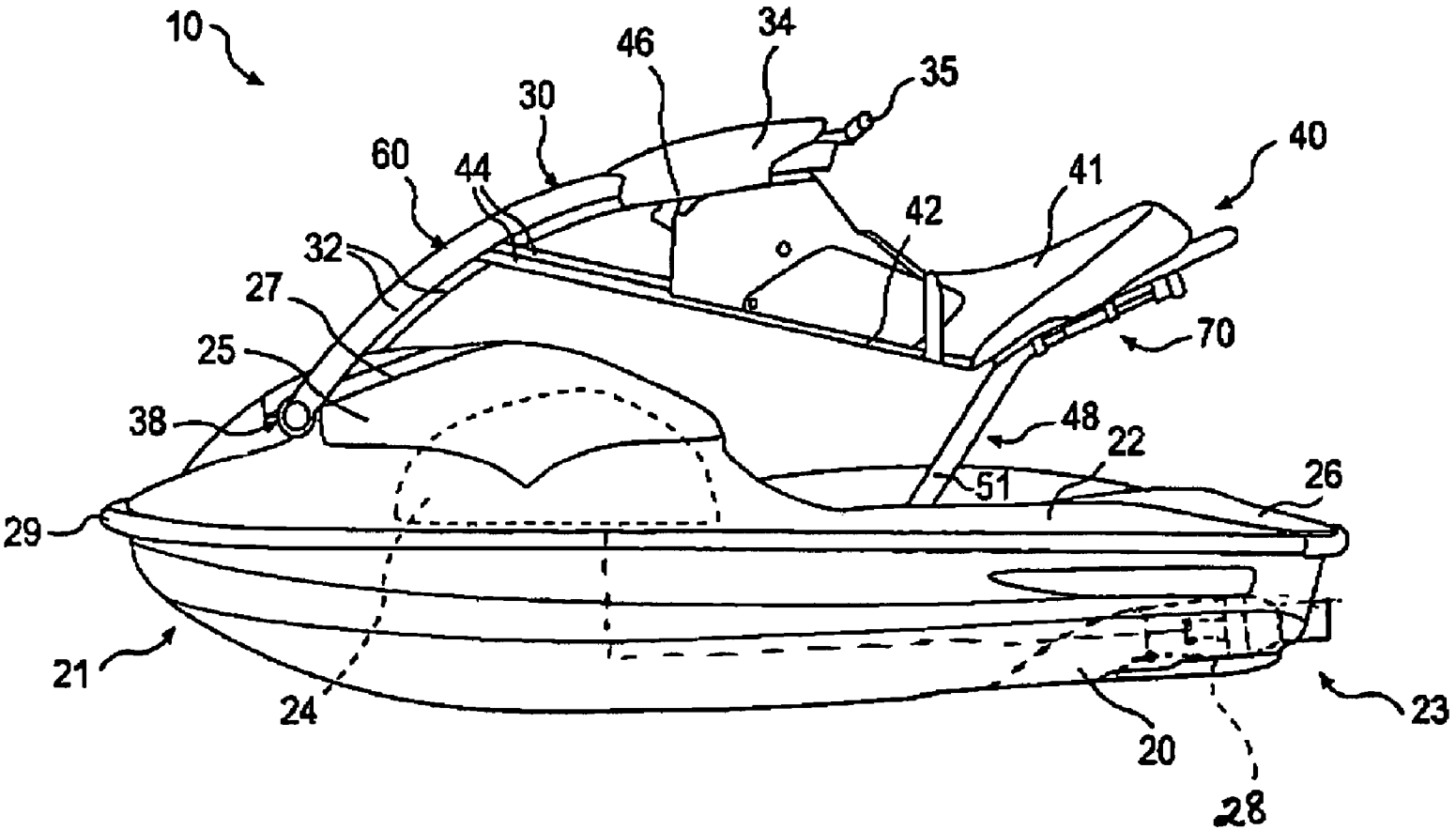
FIG. 1 is a side view of a PWC in accordance with one embodiment of the present invention with a straddle seat assembled to the PWC.

FIG. 1 is a side view of the convertible PWC 10 in the straddle-type configuration. The PWC 10 of FIG. 1 is a watercraft made of two main parts, including a hull 20 and a deck 22. The hull 20 buoyantly supports the PWC 10 in the water and is typically molded from fiberglass material and partially lined internally with buoyant foam material. The hull 20 is shaped and includes a bow or forward hull portion 21 and a stem or rearward hull portion 23. The deck 22 complements the hull 20 and is also typically molded from fiberglass material. The hull 20 and deck 22 are joined together in a sealing relationship at a seam 29, such that no water may enter the space between the hull 20 and the deck 22.

The space between the hull 20 and the deck 22 forms a cavity that accommodates a power source 24, as well as one or more other components. Such other components may include, but are not limited to, a gas tank, an electrical system (battery, electronic control unit, etc.), and other elements required or desirable in the PWC 10. The engine 24 is fixedly disposed, and generally immovable, with respect to the hull forward portion 21 and the deck 22. The power source 24 is preferably a two-stroke engine, such as a Rotax engine. It is also contemplated that the engine may be a four-stroke engine.

Preferably, the engine 24 is operatively connected to a jet propulsion system 28 (shown schematically), also supported by the hull 20, that is used to propel the PWC 10. It is contemplated that any jet propulsion system that is designed for a PWC may be used. The specific design of the propulsion system is not vital to the invention, and is therefore not described, though it will commonly be of the water jet type.

As shown in FIG. 1, the deck 22 is typically shaped and preferably includes a standing platform 26 disposed at the rear. The standing platform 26 is sized to accommodate a driver in the stand-up or kneeling position and preferably includes a non-slip surface to allow the driver's feet to remain in place on the platform 26, even when wet.

The deck 22 further includes an engine access opening for access to the power source 24 and any other component described above. A hatch 25, or cover, is disposed over the opening and, hence, the power source 24 such that the hatch 25 essentially becomes part of the deck 22 when in the closed position. The hatch 25 may be removably mounted to the deck 22 so that it may be fully removed from the PWC 10. Preferably, the hatch 25 is hingedly attached to the deck 22 such that it may be moved to an open position, yet still remain attached to the deck 22. The hatch 25 preferably includes at least one locking mechanism that ensures that the hatch 25 remains in the closed position when the PWC 10 is in operation. Such locking mechanisms are preferably releasable when suitable force is applied to them by a person.

A steering handle support assembly 30 is provided on the deck 22 to steer the PWC 10. As shown in FIGS. 1–4, and 6, the steering handle support assembly 30, or front pole assembly, includes pivotal front support poles 32 that pivot about a horizontal axis at a front attachment point 38 on the deck 22. The front support poles 32 differ from conventional front poles, which are typically a single pivoting arm, in that they are preferably formed as a pair of poles 32. The pair of poles 32 can be formed of a pair of pipes or tubes, each pivoted at a separate but aligned point on the deck 22.

In the preferred embodiment, the poles 32 extend from the deck 22 and converge toward each other and end at an operator control center including a steering device support 34. This design provides strength and is adapted for adding and removing components. Alternatively, the front poles 32 may be configured as a single support element with a central open web or cut out. The steering handle support assembly 30 may also be configured to support additional control mechanisms, such as the on/off switch and the throttle or speed control lever.

As shown in the figures, a steering device 35, such as handle bars, is disposed at the end of the steering handle support assembly 30 on the support 34. Other steering devices, such as steering wheels and the like, are also contemplated. Typically, the steering device 35 is operatively connected to a pivotable nozzle (not shown) at the discharge end of the propulsion unit. As the steering device 35 turns, so does the nozzle. As commonly known, this causes thrust created by the propulsion system to be redirected, thereby causing the PWC 10 to turn.

Figure 8:
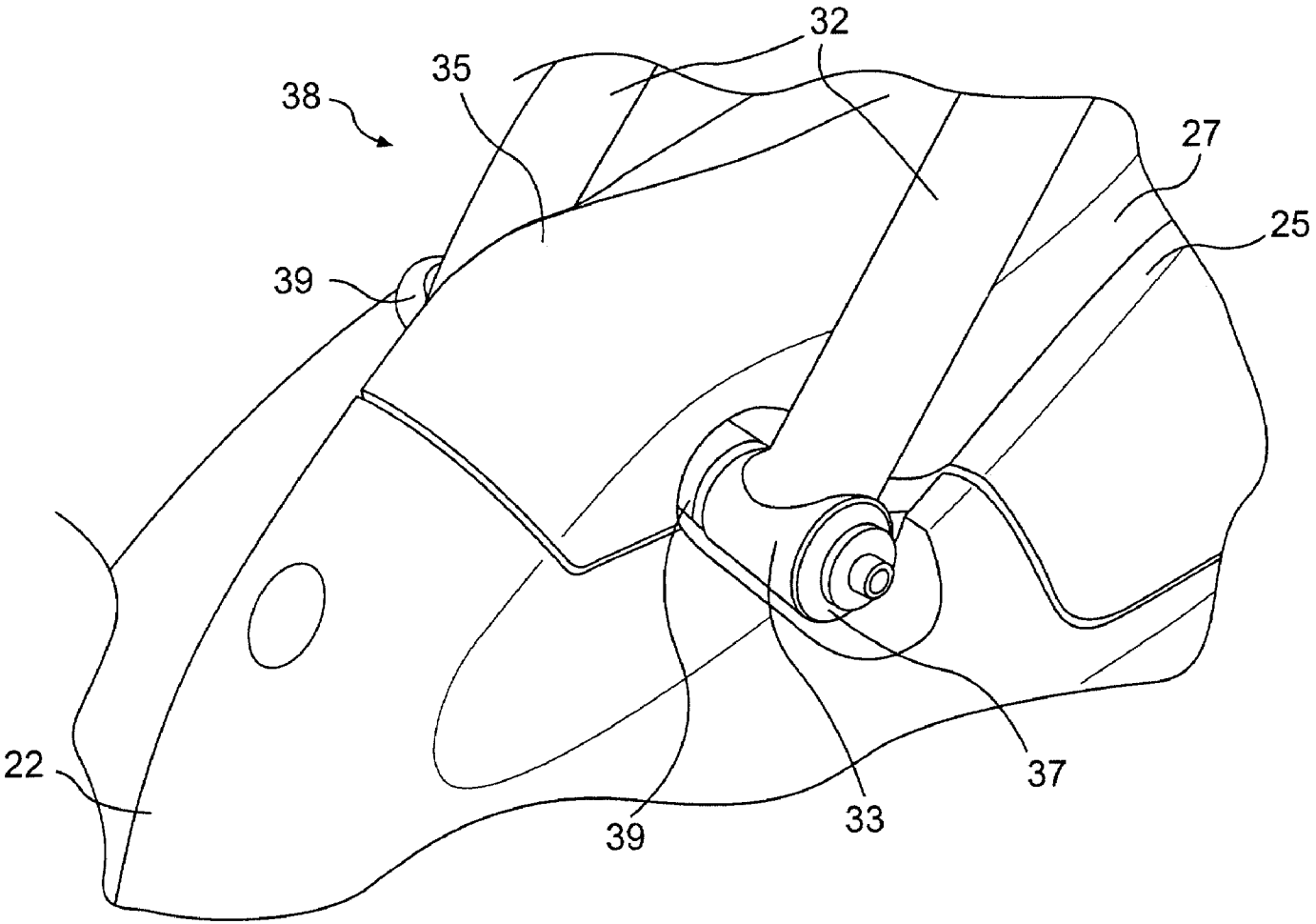
FIG. 8 is a top perspective view of a front attachment point of a front pole assembly of the PWC of FIG. 1.

FIG. 8 shows an enlarged view of the front attachment point 38 for the steering handle support assembly 30. The details of only one pole 32 is shown, but it is understood that each pole 32 may include the same design. As shown, the pole 32 includes an end attachment portion 33 that is disposed substantially perpendicular to the rest of the pole 32. The end attachment portion 33 is pivotally attached to a support 39 that is disposed on the deck 22 or beneath the deck 22 secured to the hull or vehicle frame. The end attachment portion 33 may be a pipe or tube-like structure that is of a substantially cylindrical shape and is hollow such that it may receive the support 39 internally. The end attachment portion 33 may be formed as part of the pole 32 or may be a separate piece that is welded to the pole 32.

The support 39 is disposed on or beneath the deck 22 such that it is rigidly attached to the PWC 10. Additional structure (not shown) may be provided to ensure the steering handle assembly 30 cannot twist with respect to the deck 22. As shown, the support 39 is a single bar on which both poles 32 are pivotally attached at opposite ends. It is also contemplated that the support 39 may be a pair of separate supports on which each pole 32 is disposed. The support 39 is preferably of a cylindrical shape such that the end attachment portion 33 may be slid onto the support 39. Preferably, an end cap 37 is attached to the support 39 to hold the pole 32 in position, yet still allow the pole 32 to pivot about the support 39. Any type of fastener may be used to secure the end cap 37 to the support 39, such as bolts and the like. It is contemplated that the end attachment portion 33 of the poles 32 and the support 39 may be of any complementary design such that the poles 32 are pivotally attached to the PWC 10.

As shown in FIG. 8, the hatch 25 may extend over the support 39 such that the support 39 is accessible when the hatch 25 is in the open position. Also, the hatch 25 may be pivoted about the same support 39 for the poles 32.

Figure 5:
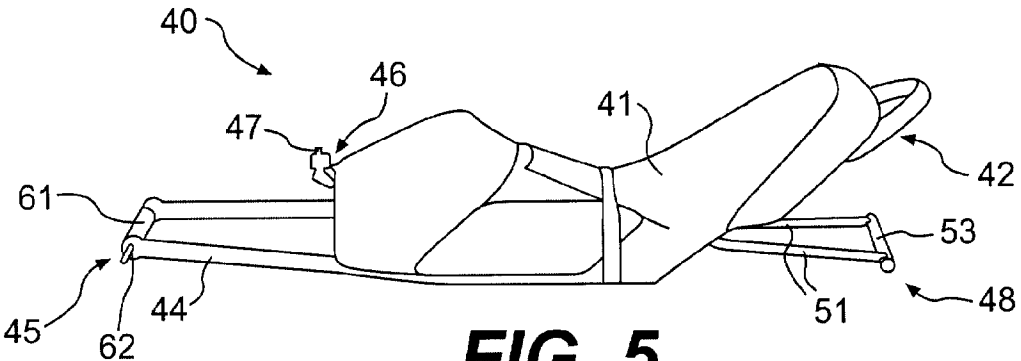
FIG. 5 is a top perspective view of the straddle seat of FIG. 1 fully disengaged from the PWC.

FIG. 1 also shows a removable seat assembly 40 fully attached to the PWC 10. FIG. 5 shows the same seat assembly 40 fully removed from the PWC 10. The seat assembly 40 shown in FIG. 1, and FIG. 5 is a straddle-type seat assembly and includes a generally V-shaped frame 42 when viewed from the side (FIG. 1) and a seat 41. The frame 42 is generally constructed from pipe or tube-like materials that provide a high strength-to-weight ratio. The seat 41 is typically padded and designed to support at least one rider. The padding of the seat 41 is preferably covered with a water-proof material. The seat 41 may be attached to the frame 42 by conventional methods, such as with fasteners and the like.

In the preferred embodiment, as shown in FIG. 1, the seat assembly 40 is attached to the steering handle support assembly 30 and also to the standing platform 26 with a seat front attachment assembly 60 and a seat bottom attachment assembly 50. The front of the seat frame 42, which is oriented towards the forward portion of the hull 21, includes the front attachment assembly 60. The front attachment assembly 60, shown in greater detail in FIG. 9, secures the seat assembly 40 to a middle portion of the steering handle support assembly 30 at a first attachment point 45 and at a second attachment point 46 that is disposed at the front of the seat 41, shown in FIG. 5, and attaches to the handle bar support 34. A seat support bracket 48 forms the seat bottom attachment assembly 50 and extends downwardly from the main seat frame 42 and attaches to the deck 22.

Figure 9:
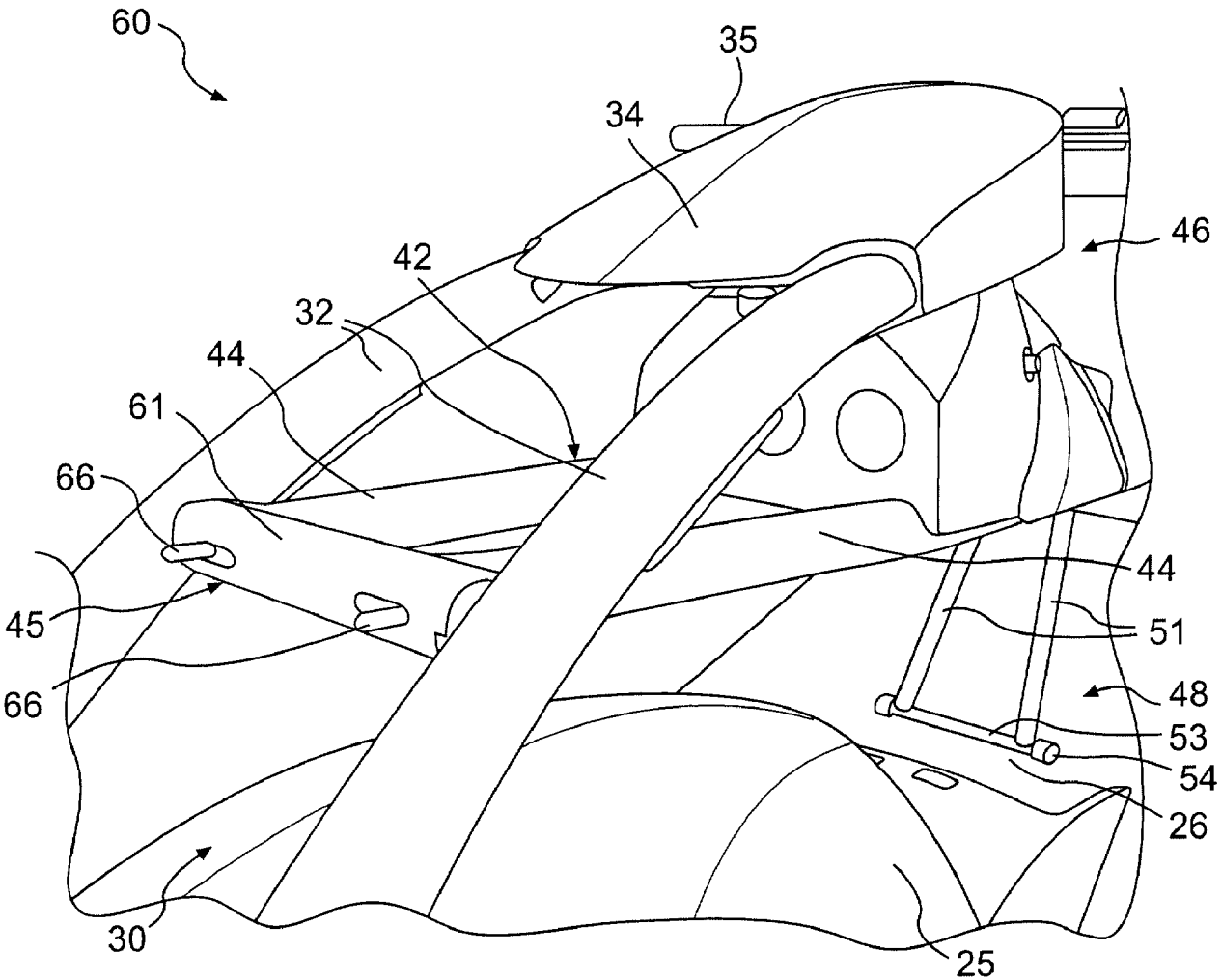
FIG. 9 is a front perspective view of a front seat attachment assembly of the PWC of FIG. 1.

FIG. 9 is an enlarged view of the front attachment assembly 60 when it is attached to the steering handle support assembly 30. Preferably, at the first attachment point 45, the front attachment assembly 60 includes a pair of support arms 44 that form part of the seat frame 42 and extend under the seat 41 and a lateral bar 61 disposed between the pair of support arms 44. The lateral bar 61 may be fastened to the support arms 44 by conventional methods, including but not limited to welding and fasteners. Preferably, the support arms 44 are welded to the lateral bar 61. The lateral bar 61 includes retractable pins or plugs 62 (seen in FIG. 5) extending from each end. In the preferred embodiment, the lateral bar 61 is disposed between the pair of poles 32 and the pins 62 extend toward each pole 32 to engage an aperture in each pole 32 directly or a mounting formation that is disposed on each pole 32. Preferably, a spring loaded sliding control mechanism 66 is provided to retract each pin 62 to disengage the seat frame 42 from the poles 32. Of course, any type of releasable connecting mechanism may be used. It would also be possible to releasably clamp the seat frame 42 to the steering handle support assembly 30 or for the steering handle support assembly 30 to carry the releasing connecting mechanism.

Figure 2:
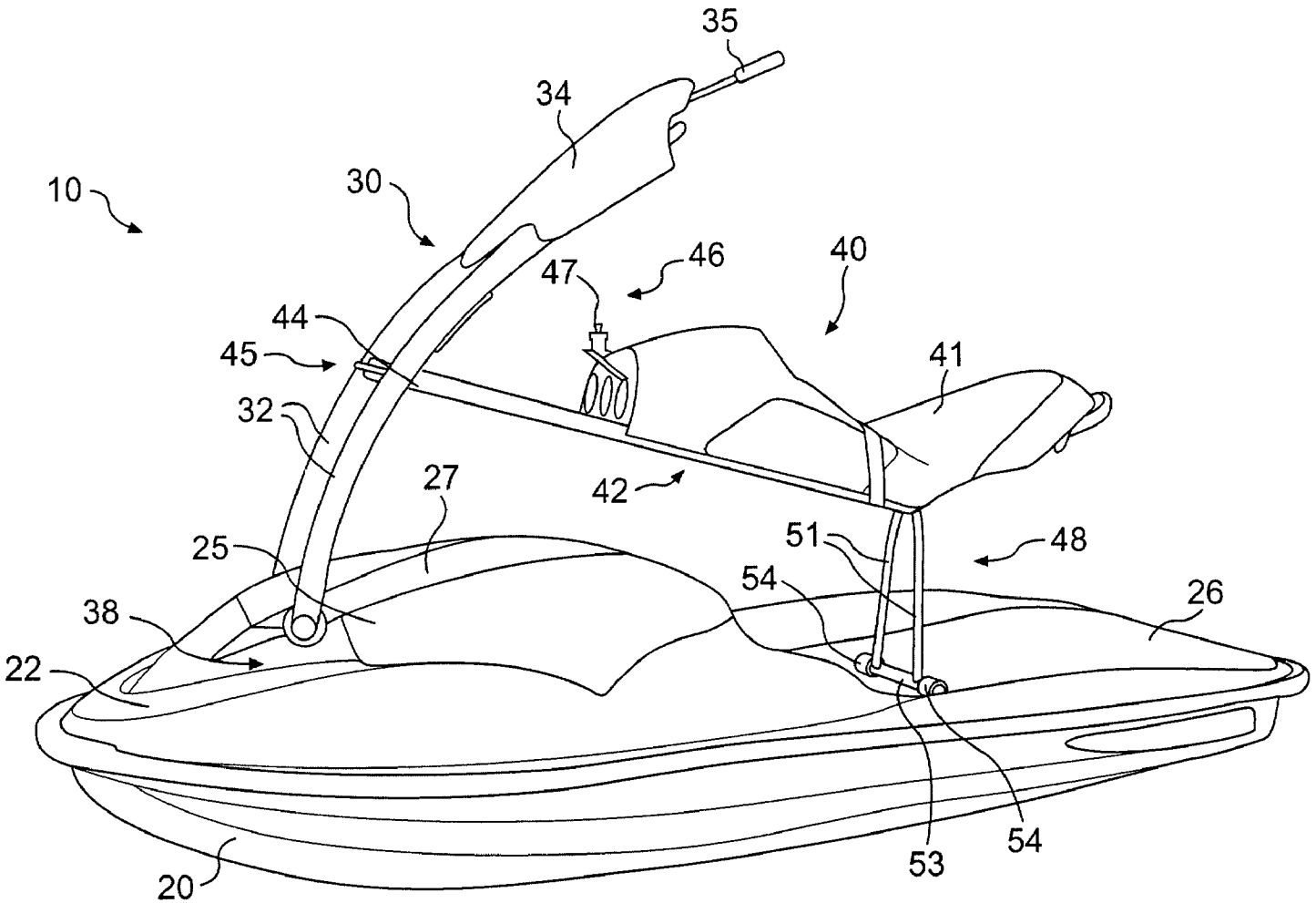
FIG. 2 is a front perspective view of the PWC of FIG. 1 with the straddle seat partially disengaged from the PWC.
Figure 10:
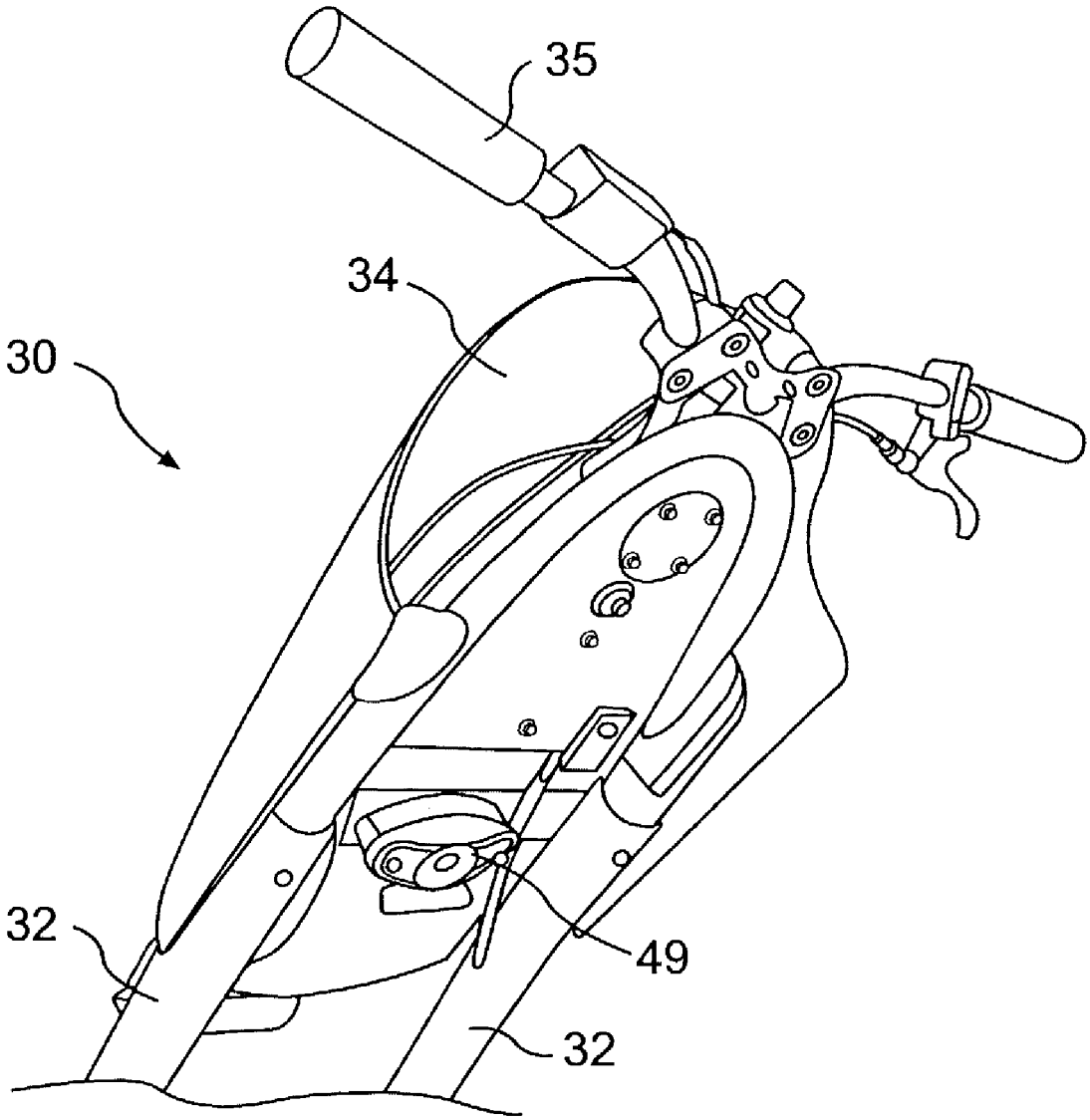
FIG. 10 is a bottom perspective view of an opposite end of the front pole assembly of the PWC of FIG. 8.

FIG. 2 illustrates the seat assembly 40 partially disassembled from the PWC 10, with the second attachment point 46 disengaged. The second attachment point 46, as seen, is preferably formed by a pin 47. The pin 47 is releasably retained in a dilating ring 49 that is disposed on the bottom of steering device support 34, shown in FIG. 10. The dilating ring 49 is preferably formed in the underside of the steering device support 34. The pin 47 may be released with a latch positioned adjacent the handle bars 35 on the handle bar support 34. Alternatively, the pin 47 may be press fit and removed by an application of suitable force. Of course, other types of releasable connectors may be used.

Figure 3:
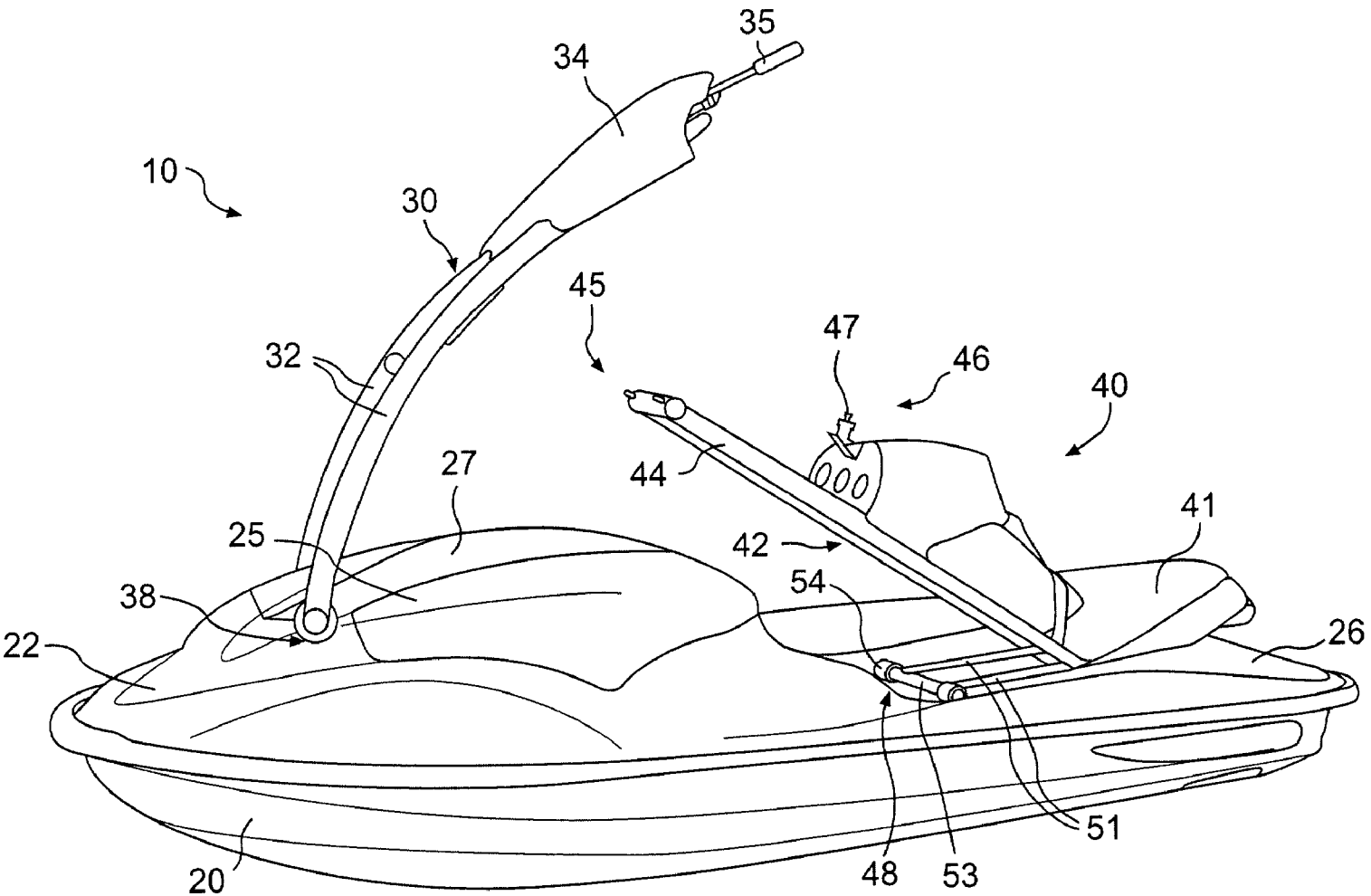
FIG. 3 is a front perspective view of the PWC of FIG. 1 with the straddle seat further disengaged from the PWC.

FIG. 3 shows the PWC 10 with the seat assembly 40 further disengaged by complete detachment of the front attachment assembly 60. In addition to the second attachment point 46 being disengaged, the first attachment point 45 is disengaged from the front poles 32. As seen, the seat support bracket 48 pivots to assist in the disengagement.

Figure 7:
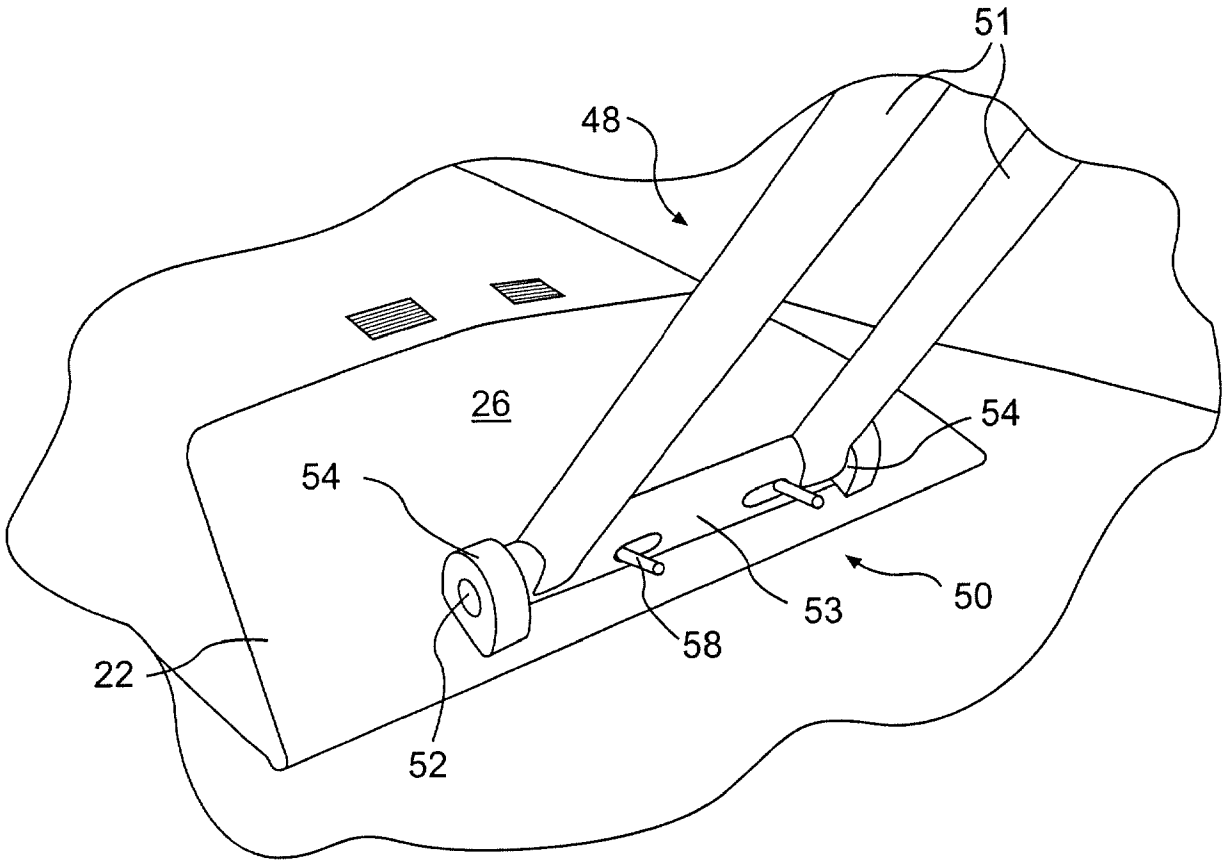
FIG. 7 is a top perspective view of an attachment mechanism for a seat support bracket that is secured to a deck of the PWC of FIG. 1.

FIG. 7 is an enlarged view of the seat bottom attachment assembly 50 for the seat support bracket 48 that is secured onto the deck 22. As seen, the bracket 48 extends downwardly at an angle from the seat frame 42 and includes a pair of arms 51 and a lateral base 53. The pair of arms 51 may be disposed on the base 53 or the base 53 may be disposed in between the arms 51. Conventional fastening methods, including but not limited to welding and fasteners may be used to attached the arms 51 to the base 53. Preferably, the arms 51 are welded to the base 53.

In the preferred embodiment, the lateral base 53 includes a pair of pins 52 extending from the ends of the base 53. The pins 52 are releasably retained in a pair of apertures formed in support ears 54 protruding from the deck 22. The support ears 54 may be attached to the deck 22 by conventional methods or may be secured to the hull or the vehicle frame through the deck 22. The lateral base 53 further includes a sliding control mechanism preferably formed as a spring loaded lever 58 that can retract each pin 52 within the base 53 to disengage the bracket 48 from the support ears 54. Of course, any release mechanism may be used to retain and easily disengage the seat bracket 48 from the deck 22.

Figure 4:
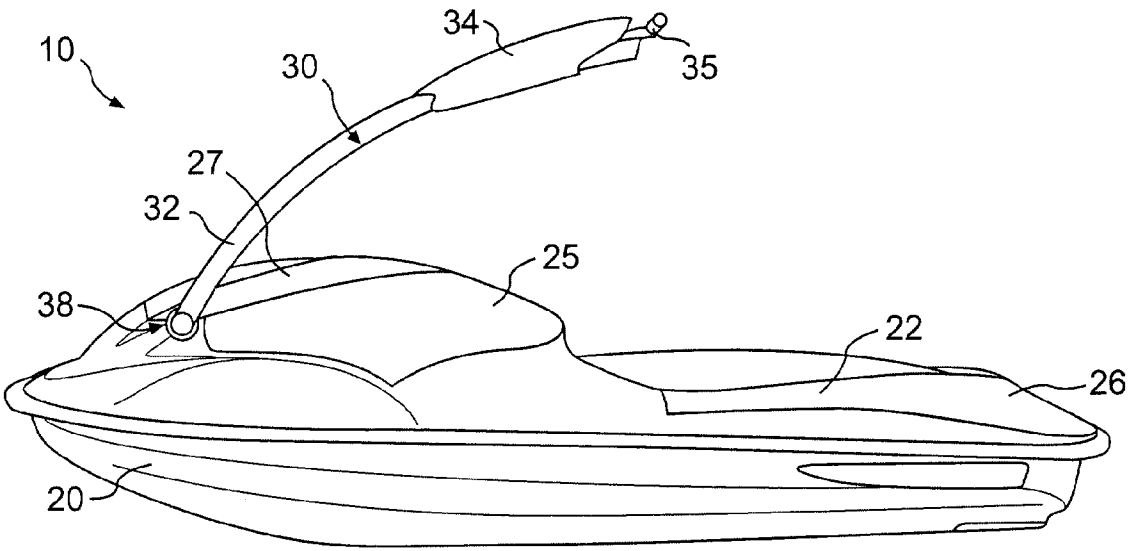
FIG. 4 is a side view of the PWC of FIG. 1 in a stand-up configuration with the straddle seat fully disengaged from the PWC.
Figure 6:
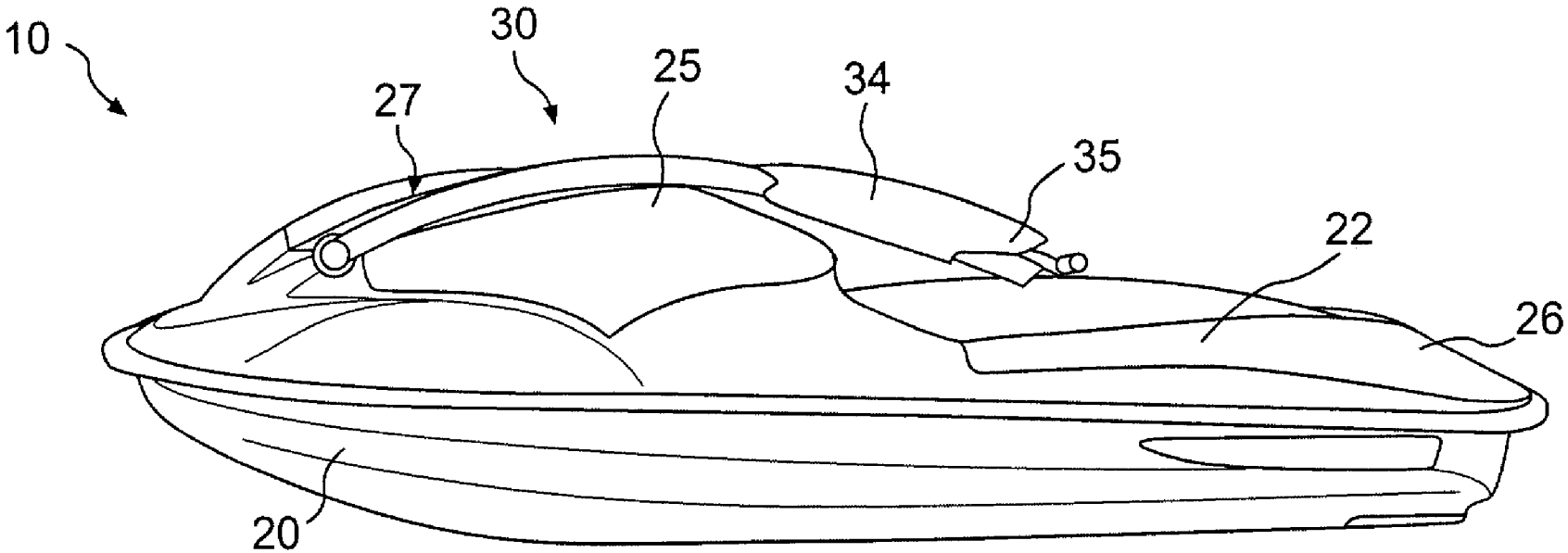
FIG. 6 is a side view of the PWC of FIG. 4 with the stand-up configuration in a stored position.

FIG. 4 shows the PWC 10 in its stand-up configuration with the seat assembly 40 (FIG. 5) fully disengaged and removed from the PWC 10. FIG. 6 shows the stand-up configured PWC 10 in the stored position with the front poles 32 collapsed. As shown, the deck 22, especially the hatch 25, is configured to allow the poles 32 to collapse.

Preferably, a pair of indentations 27 are provided on the hatch 25 that accept the poles 32 when they are pivoted downwardly.

Figure 11:
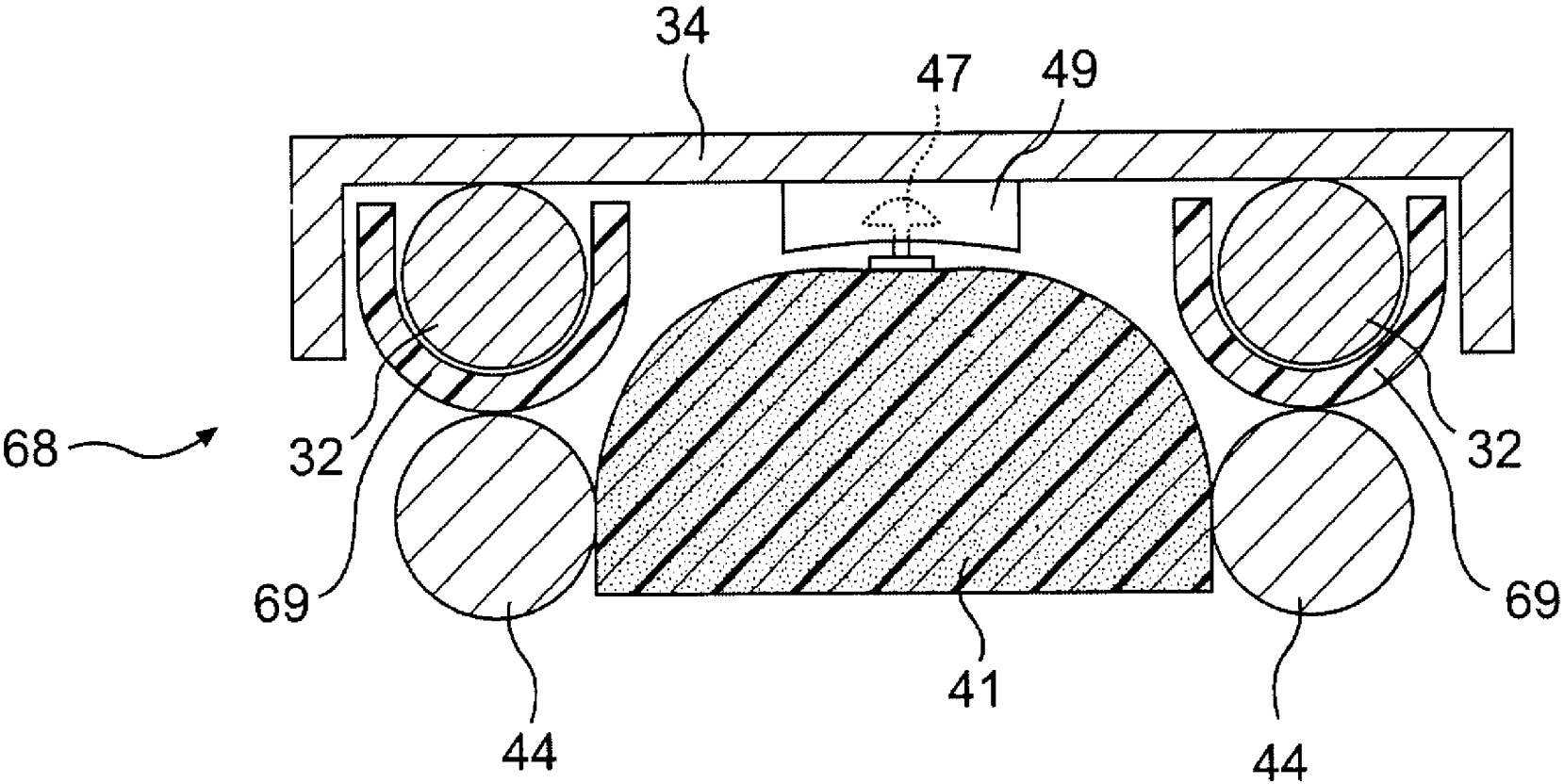
FIG. 11 is a cross-sectional view of a lateral locking mechanism for use with the PWC of FIG. 10.

To control or limit lateral movement on any of the configurations disclosed herein, a lateral locking mechanism 68, as shown in FIG. 11, may be used. The lateral locking mechanism 68 includes U-shaped channels 69 attached to support arms 44 that receive the poles 32 of the steering assembly 30. The pin 47 removably attaches to the dilating ring 49. The lateral locking mechanism 68 may be used-to provide lateral stability and to stiffen the attachment if desired.

Figure 12:
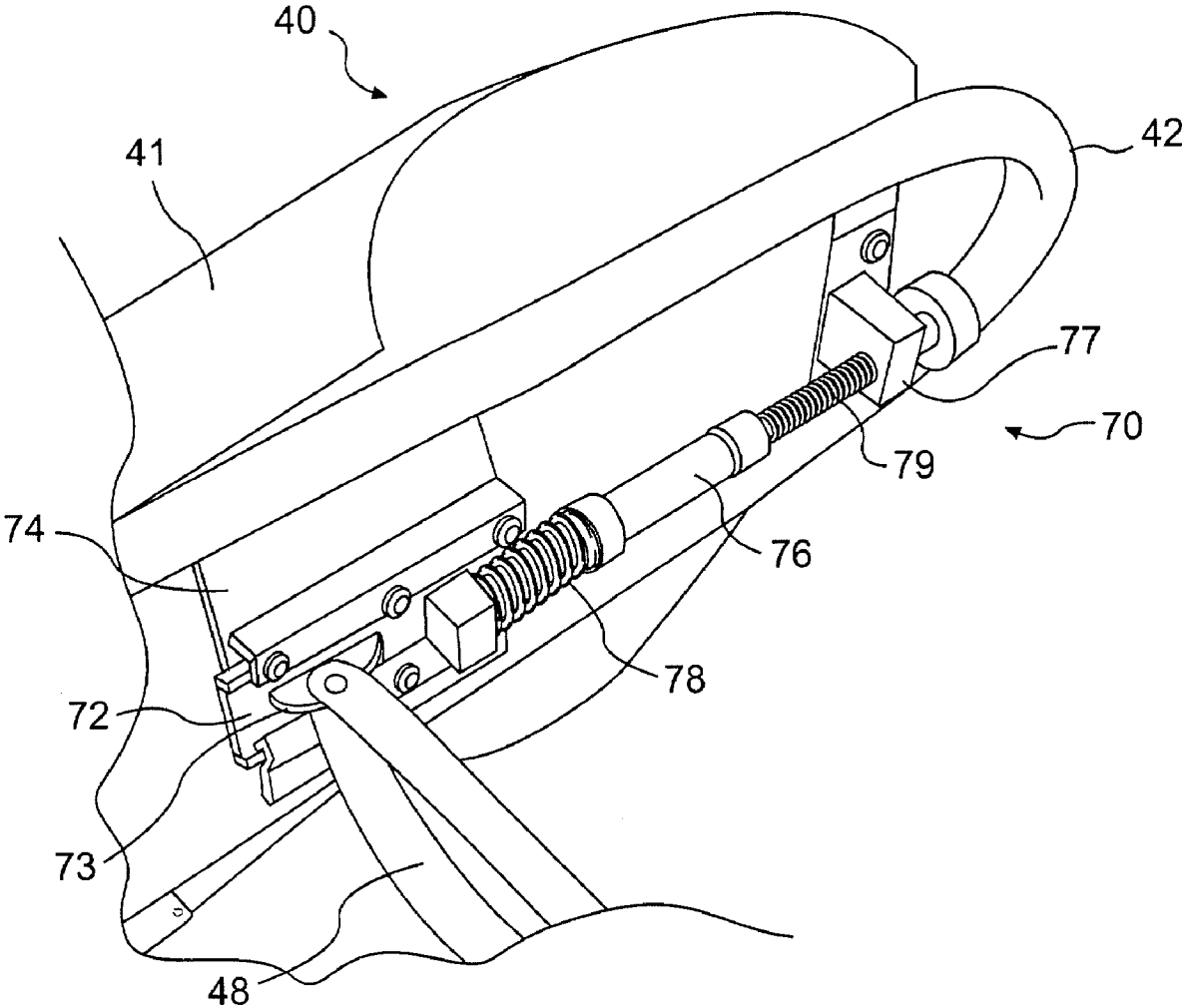
FIG. 12 is a bottom perspective view of a suspension assembly for use with the straddle seat of FIG. 5.

A suspension assembly 70 can be provided for the seat assembly 40, as seen in FIG. 1 under the seat frame 42 and in FIG. 12 in greater detail. The suspension assembly 70 is disposed on the bottom of the frame 42 adjacent the seat support bracket 48. The suspension assembly 70 includes a slider 72 having a tab 73. The slider is received in the slider bracket 74. The seat support bracket 48 is pivotally attached to the tab 73. A spring 78 is attached at the front to the rear portion of the slider 72 and at the back to an adjustable tensioning rod 76. A turn screw 79 received at one end in the tensioning rod 76 and at the other in a receiving member 77 affixed to the frame 42 is used to adjust the resilience of the spring 78. This arrangement allows the seat frame 42 to pivot or flex with respect to the bracket 48 by having the slider 72 move longitudinally, and the degree of resilience of the suspension assembly 70 may be adjusted based on user preference.

Of course, any type of suspension assembly may be used to allow the seat 40 to move with respect to the hull 20 to provide a more comfortable ride during operation. For example, a hydraulic or pneumatic cylinder and piston may be used. Similarly, a resilient fitting, for example a rubber fitting, may be provided. Shock absorbers supported by the deck are also possible. A similar suspension assembly may be provided for the sit-down seat configuration.

In an alternative embodiment, not shown, it is contemplated that the seat front attachment point may be formed of only one connection point at the front pole assembly. The seat bottom attachment point can remain the same or at any point below the seat assembly 40. A suspension assembly may also be provided.

As can be appreciated by the above description, the seat assembly 40, also referred to as a removable module, may be selectively removed by an operator whenever it is desired. By this removable or modular seat arrangement, a single PWC frame or hull and deck may be used with various operator styles, including stand-up, straddle seated or bucket seated.

Figure 13:
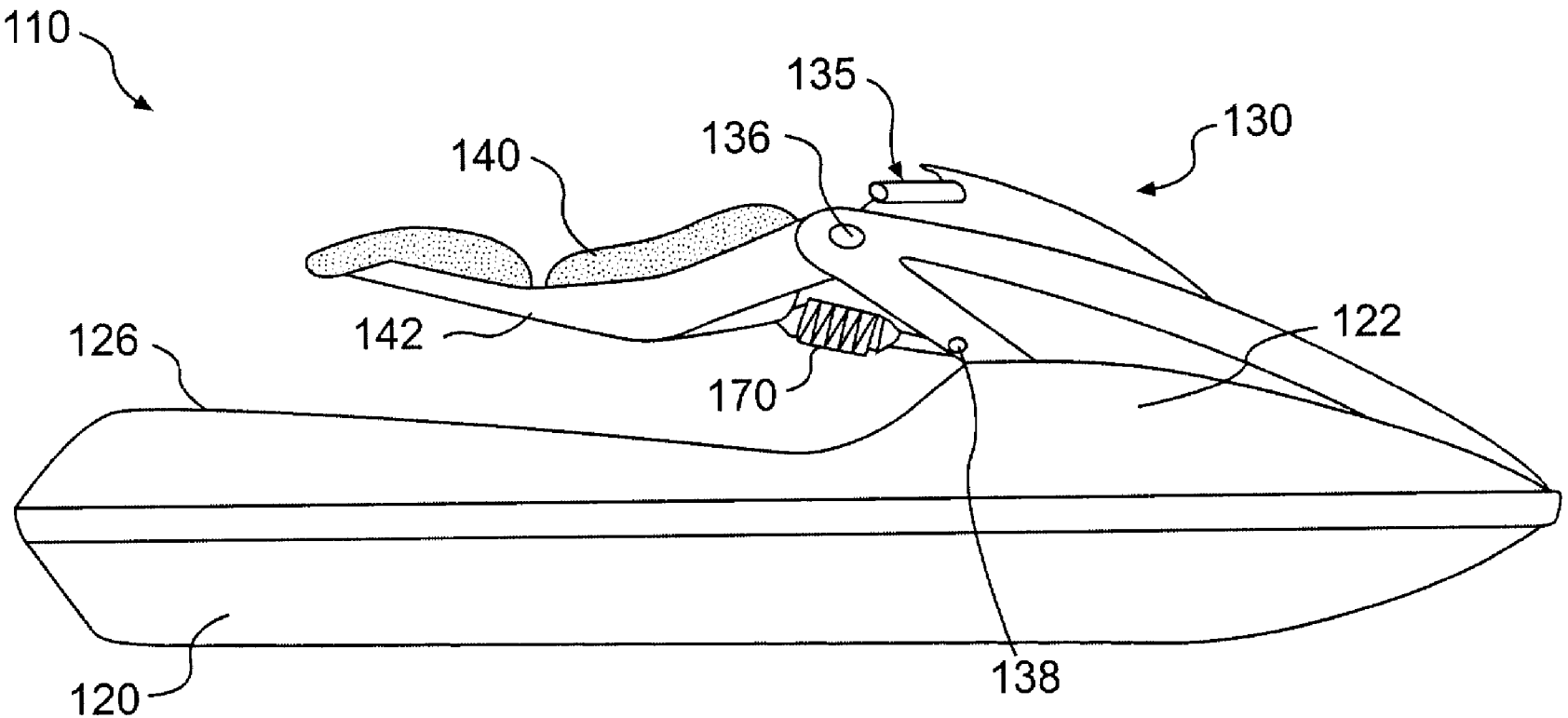
FIG. 13 is a side view in accordance with another embodiment of the present invention with a straddle seat assembled to the PWC.

FIG. 13 shows another embodiment of the PWC 110 in which the hull 120 and deck 122 are similar to a conventional stand-up watercraft. A front steering support structure 130 mounted on the forward portion of the PWC 110 is used to support the steering system 135. A seat assembly 140 is suspended in a cantilever manner from the front steering support structure 130. The seat assembly 140 attaches at a seat front attachment point 136 and a seat bottom attachment point 138. Like the other embodiments, the seat 140 may be removed. In this embodiment, the front steering support 130, however, does not move relative to the hull 120, but is instead in a fixed position.

As seen in FIG. 13, the front structure 130 is preferably formed as a structural support that cantilevers from the bow over the standing platform 126. The support 130 may be in the form of a V-shaped beam. A suspension mechanism 170 may be provided, as seen, between the bottom of the seat frame 142 and the front structure 130 or deck 122 to allow the seat 140 to flex with respect to the structural support 130. Of course, any type of suspension mechanism may be used, such as springs, hydraulic or pneumatic cylinders.

This configuration can also be convertible to a stand-up style by removing the seat assembly 140 by disengaging the seat front attachment point 136 and the seat bottom attachment point 138. Then, the driver can stand on the platform 126 during operation.

Figure 14:
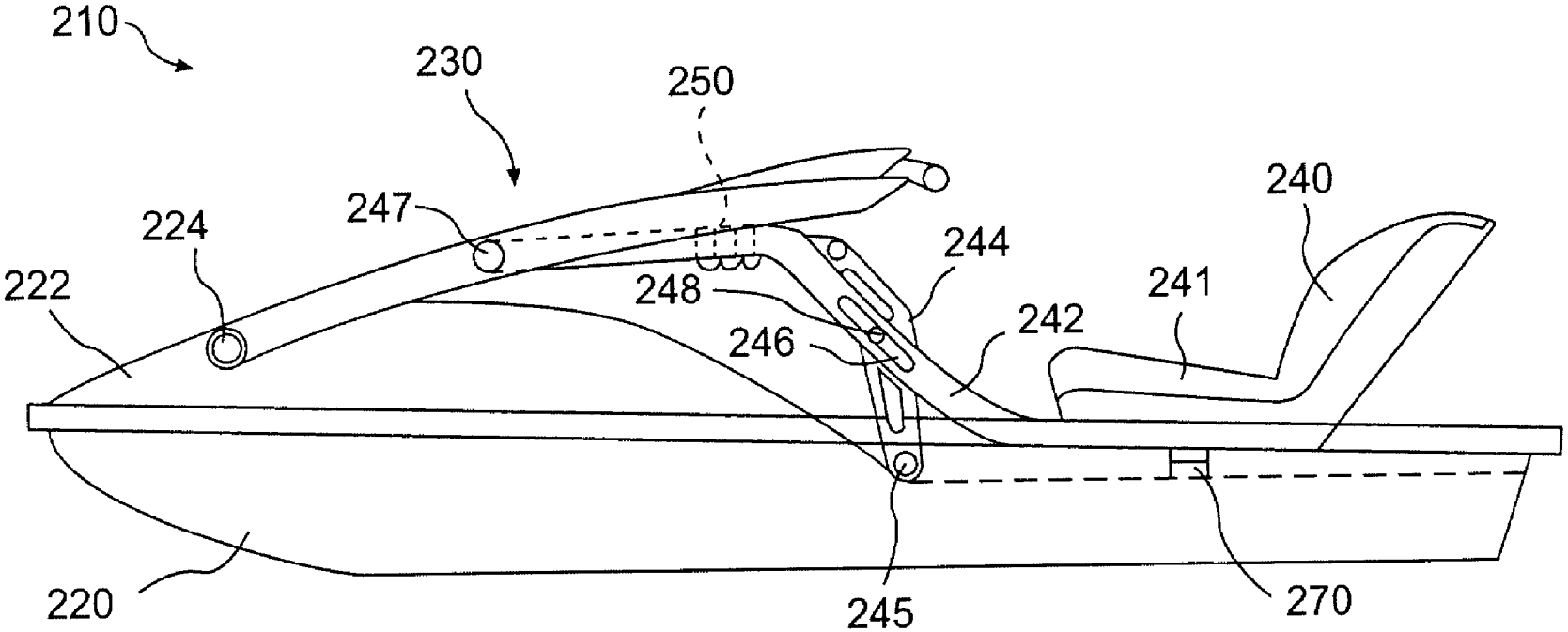
FIG. 14 is a side view in accordance with a further embodiment of the present invention with a bucket seat assembled to the PWC.

FIG. 14 shows a further embodiment of the PWC 210 in which a bucket type seat assembly 240 is suspended from the front steering assembly 230. Again, the seat assembly 240 is disposed on the PWC 210 that is suitable for stand-up use and is selectively attachable. The seat assembly 240, as shown, is a bucket type seat, but may be any type of seat known for use with a watercraft. This type of seat assembly 240 allows the rider to be in a recumbent position while operating the watercraft 210. In this embodiment, the steering assembly 230 is a pole assembly, preferably a double pipe assembly, as described previously, that is supported for movement with respect to the deck 222 about a horizontal axis at point 224.

In this embodiment, the seat assembly 240 includes a frame 242 that is formed as a lever with a generally Z shape, with one end removably attached to the steering pole assembly 230 and the other end supporting a seat cushion 241. A single seat frame 242 may be used at a central position of the seat or on one side, or a pair of seat frames 242 on each side of the seat cushion 241 may be used. A support link 244, shown as an inverted L shape, is pivotally attached to the deck 222 at one end 245 and is attached at the steering pole assembly 230 at the other end 247 with a biasing mechanism 250, such as a spring and shock absorber assembly. The support link 244 and the support lever 242 are interconnected with a slot 246 and pin 248 arrangement to allow limited movement between them. By this, the link 244 permits controlled movement of the suspended seat assembly 240. A resilient bumper element 270 may be positioned under the seat assembly 240. Of course, any other type of mechanism that limits or controls movement may be used. The seat cushion 241 may be mounted at different points along the frame 242, for example in a raised position or a lowered position, depending on the rider's preference.

In another alternative configuration, not illustrated, the link may be in a triangular configuration with one point pivotally attached to the deck, another point pivotally attached to a suspension system extending from the steering pole assembly, and a third point attached to the seat lever.

In a further alternative configuration, not illustrated, the modules are not attached to the steering pole assembly and are held in place solely by one or more attachment assemblies on the deck.

Preferably, all of the above disclosed embodiments are designed for a tool-less transformation between stand up and seated operation. The various seat mounting arrangements have connectors that allow for manually releasable operation. Such connectors may be sliding pin mechanisms, as described above, or may be formed of any other configuration that allows easy, manual connection and release. Thus, any operator can quickly and easily convert the PWC in accordance with their driving preference. Additionally, as all of the connectors are integral with the assembly, the risk of losing small connecting pieces is eliminated.

The description and figures described herein are intended to be illustrative of the invention. It is contemplated that other support configurations and connectors may be used to achieve a similar result and remain within the inventive concept of a PWC with removable components that allow a user to select and modify the type of PWC.

What is claimed is:

1. A personal watercraft comprising:

a hull;

a deck supported by the hull;

a power source supported by the hull;

a jet propulsion unit supported by the hull to propel the personal watercraft;

a steering handle support assembly having a first end and a second end, the first end pivotably connected to a forward portion of the watercraft and the second end having a steering handle connected thereto to steer the personal watercraft, wherein the steering handle support assembly can pivot between a lowered position in proximity to the deck and at least a raised position in which the steering handle is spaced away from the deck; and a seat assembly removably supported by the deck, such that the seat assembly can be fully disengaged from the deck by a user so that when the steering handle support assembly is raised the personal watercraft can be dirigibly operated by the steering handle by the user sitting on the seat assembly and can be dirigibly operated by the steering handle by the user supported on the deck with the seat assembly fully disengaged from the deck, the seat assembly being releasably connected to the steering handle support assembly at a first attachment point provided on the steering handle support assembly.

2. The personal watercraft of claim 1, wherein the seat assembly is a straddle-type seat.

3. The personal watercraft of claim 1, wherein the seat assembly is a bucket-type seat.

4. The personal watercraft of claim 1, wherein the deck includes a standing platform positioned substantially rearward of the steering handle support assembly for the user to stand upon while operating the personal watercraft.

5. The personal watercraft of claim 1, wherein the seat assembly includes a suspension assembly.

6. The personal watercraft of claim 1, wherein the steering handle support assembly includes a pivoting support pole assembly.

7. The personal watercraft of claim 1, wherein the steering handle support assembly includes a pair of poles pivotally supported with respect to the deck.

8. The personal watercraft of claim 1, wherein the seat assembly releasably connects to the deck at a deck attachment point.

9. The personal watercraft of claim 1, wherein the seat assembly is suspended from the steering handle support assembly.

10. A seat assembly for use with a personal watercraft, the watercraft having:

a hull;

a deck supported by the hull;

a power source supported by the hull;

a jet propulsion unit supported by the hull and operatively connected to the power source to propel the personal watercraft;

a steering handle support assembly having a first end pivotably connected to a forward portion of the watercraft and a second end having a steering handle connected thereto to steer the personal watercraft, such that the steering handle support assembly can pivot between a lowered position in proximity to the deck and at least a raised position in which the steering handle is spaced away from the deck;

the seat assembly comprising:

a seat;

a seat frame;

a first releasable connector for connecting the seat frame to a first point on the steering handle support assembly; and a second releasable connector for connecting the seat frame to a second point on the personal watercraft;

when the steering handle support assembly is raised, the watercraft is dirigibly operable by the steering handle with the seat assembly fully disengaged from the watercraft by a user supported on the deck and with the seat assembly connected to the watercraft by a user sitting on the seat.

11. The seat assembly of claim 10, further comprising a suspension assembly coupled to the seat frame.

12. A personal watercraft comprising:

a hull;

a deck supported by the hull;

a steering handle support assembly having a first end and a second end having a steering handle connected thereto to steer the personal watercraft, the first end pivotably connected to a forward portion of the watercraft such the steering handle support assembly can pivot between a lowered position in a proximity to the deck and at least a raised position in which the steering handle is spaced away from the deck;

a power source supported by the hull; and a first attachment assembly on the steering handle support assembly, the first attachment assembly being configured to releasably attach a seating assembly;

the watercraft being dirigibly operable by the steering handle when the steering handle support assembly is raised with the seating assembly fully disengaged from the watercraft by a user supported on the deck and with the seat assembly attached to the steering handle support assembly by a user sitting on the seat assembly.

13. The personal watercraft of claim 12, wherein the deck includes a standing platform positioned substantially rearward of the steering handle support for the user to stand upon while operating the personal watercraft.

14. The personal watercraft of claim 12, wherein the steering handle support assembly includes a pivoting support pole assembly.

15. The personal watercraft of claim 12, further comprising a second attachment assembly configured to releasably attach the seating assembly.

16. The personal watercraft of claim 15, wherein the second attachment assembly is disposed on the deck.

17. The personal watercraft of claim 1, wherein the weight of the seat assembly is at least partially borne by the steering handle support assembly.

18. The personal watercraft of claim 1, wherein, when the seat assembly is in use with the watercraft, the deck includes a standing platform positioned under the seat assembly.

19. The seat assembly of claim 10, wherein, when the seat assembly is attached to the steering handle support assembly, the weight of the seat assembly is at least partially borne by the steering handle support assembly.

20. The personal watercraft of claim 12, wherein the weight of the seat assembly is at least partially borne by the steering handle support assembly.

21. The personal watercraft of claim 12, wherein the deck includes a standing platform positioned rearward of the steering handle support assembly.

22. A personal watercraft comprising:

a hull;

a deck supported by the hull, the deck including a standing platform for a user to stand on when operating the watercraft;

a power source supported by the hull;

a jet propulsion unit supported by the hull to propel the personal watercraft;

a steering handle support assembly having a first end and a second end, the first end pivotably connected to a forward portion of the watercraft and the second end having a steering handle connected thereto to steer the personal watercraft, and a seat assembly releasably connected to the steering handle support assembly at a first attachment point provided on the steering handle support assembly and removably supported by the deck in a position over the standing platform, such that the seat assembly can be selectively removed by a user, wherein the personal watercraft can be dirigibly operated by the steering handle with the seat in place and the user seated thereon and can be dirigibly operated by the steering handle with the seat assembly removed from the deck and the user standing on the standing platform.

* * * * *